US006833463B2

(12) United States Patent
Halpern et al.

(10) Patent No.: US 6,833,463 B2
(45) Date of Patent: Dec. 21, 2004

(54) TRANSESTERIFICATION USING PHASE TRANSFER CATALYSTS

(75) Inventors: Marc E. Halpern, Cherry Hill, NJ (US); Darrell Crick, Shamong, NJ (US)

(73) Assignee: PTC Organics, Inc., Mount Laurel, NJ (US)

( * ) Notice: Subject to any disclaimer, the term of this patent is extended or adjusted under 35 U.S.C. 154(b) by 0 days.

(21) Appl. No.: 10/784,713

(22) Filed: Feb. 24, 2004

(65) Prior Publication Data

US 2004/0167343 A1 Aug. 26, 2004

Related U.S. Application Data

(63) Continuation of application No. PCT/US02/27276, filed on Aug. 28, 2002.

(60) Provisional application No. 60/315,582, filed on Aug. 29, 2001.

(51) Int. Cl.[7] ..... C11C 3/00

(52) U.S. Cl. ..... 554/169; 554/167; 554/168; 508/485

(58) Field of Search ..... 554/167, 168, 554/169; 508/485

(56) References Cited

PUBLICATIONS

Mar. 20, 2003. PCT International Search Report from PCT/US02/27276.

*Primary Examiner*—Deborah D. Carr
(74) *Attorney, Agent, or Firm*—Wilmer Cutler Pickering Hale and Dorr LLP

(57) ABSTRACT

The invention provides reaction mixtures comprising polyols, triglycerides, base initiators and phase-transfer catalysts for performing transesterification reactions. The reaction product comprises a mixture of polyol monoesters, polyol diesters, triglycerides and glycerol.

27 Claims, No Drawings

TRANSESTERIFICATION USING PHASE TRANSFER CATALYSTS

RELATED APPLICATION

This application is a continuation of PCT application Ser. No. PCT/US02/27276 filed Aug. 28, 2002, which claims priority to U.S. Provisional Patent Application No. 60/315,582 filed Aug. 29, 2001, both of which are incorporated herein by reference.

FIELD OF THE INVENTION

The invention provides reaction mixtures comprising polyols, triglycerides, base initiators and phase-transfer catalysts for performing transesterification reactions. The reaction product comprises a mixture rich in polyol monoesters and polyol diesters.

BACKGROUND OF THE INVENTION

Large-scale transesterification of triglycerides with polyols is performed commercially. In particular, mixtures rich in polyol fatty acid monoesters and polyol fatty acid diesters, such as monoglycerides and diglycerides are commercially produced in quantities of greater than 50 million pounds per year, primarily by transesterification of triglycerides, such as fatty triglycerides, with polyols, such as glycerol and propylene glycol. Triglycerides are reacted with glycerol in the presence of a glycerolysis catalyst to provide a product that is a mixture of monoglycerides, 1,2-diglycerides, 1,3-diglycerides, glycerol, and triglycerides. A particularly useful raw material for such large volume commercial transesterifications is a mixture of fatty triglycerides, obtained from agricultural sources such as vegetable oil or animal fat. Vegetable oil triglycerides and animal fat triglycerides are inexpensive and readily available. Products rich in polyol fatty acid monoesters and polyol fatty acid diesters obtained from the transesterification of vegetable oil triglycerides with polyols, such as glycerol and propylene glycol are particularly useful for food applications, such as food emulsifiers for margarine and ice cream. Other useful transesterifications of triglycerides with polyols use tributyrin or triacetin as the triglyceride.

Mixtures rich in polyol acid monoesters and polyol acid diesters may also be produced by transesterification of fatty monoacid lower alkyl esters with polyols, such as methyl esters of fatty monoacids. However, the cost of fatty monoacid lower alkyl esters as a raw material for production of polyol fatty acid monoesters and polyol fatty acid diesters is higher than that of using fatty triglyceride as a raw material. Fatty monoacid lower alkyl esters are commercially produced by alcoholysis of fatty triglycerides using lower alcohols, such as methanol and ethanol. Alcoholysis represents an added step with added cost as compared to reacting the polyol directly with fatty triglyceride.

There is a need in the art for new and improved methods of producing polyol acid monoesters and polyol acid diesters. The invention is directed to this, as well as other, important ends.

SUMMARY OF THE INVENTION

The invention provides an improved process for performing transesterification of triglycerides with polyols, and more particularly, provides an improved process for performing transesterification of triglycerides with polyols in the presence of a base initiator and a phase transfer catalyst to produce mixtures rich in polyol monoesters and polyol diesters. In one embodiment, the invention provides an improved process for performing transesterification of fatty triglycerides with polyols in the presence of a base initiator and a phase transfer catalyst to produce mixtures rich in polyol fatty acid monoesters and polyol fatty acid diesters.

The invention also provides reaction mixtures of phase transfer catalysts, triglycerides, base initiators and polyols for use in transesterification reactions at low temperatures to produce mixtures rich in polyol monoesters and polyol diesters. In one embodiment, the invention provides reaction mixtures of phase transfer catalysts, fatty triglycerides, base initiators and glycerol or propylene glycol for use in transesterification reactions at low temperatures or low heat histories to produce mixtures rich in polyol fatty acid monoesters and polyol fatty acid diesters. In other embodiments, the transesterification reactions can avoid the use of highly processed fatty monoacid lower alkyl esters as a raw material.

These and other aspects of the invention are described in more detail below.

DETAILED DESCRIPTION OF THE INVENTION

Phase-transfer catalysis is a technique for enhancing the reactivity of anions which are soluble in one phase, with an organic reactant which is soluble in another phase, in a system in which the two phases are immiscible. Phase-transfer catalysis is used in the production of about 10 billion dollars worth of chemicals (as per the authoritative references: Halpern, "Phase-Transfer Catalysis" Ullmann's Encyclopedia of Industrial Chemistry, Volume A19, VCH, Weinheim, 1991, p.293 and "Phase-Transfer Catalysis: Fundamentals, Applications and Industrial Perspectives" by Starks, Liotta and Halpern, Chapman and Hall 1994, the contents of each of which are incorporated herein by reference). The vast majority of phase-transfer catalysis applications involve the reaction of a stoichiometric quantity of an anion with a stoichiometric quantity of an organic reactant and generate an equivalent quantity of a leaving group in the presence of phase-transfer catalysts, which is typically an ammonium or phosphonium salt, polyethylene glycol, polyethylene glycol ether, polyethylene glycol ester or crown ether.

The invention provides a reaction mixture comprising at least one phase transfer catalyst, at least one polyol, at least one triglyceride, and at least one base initiator. In one embodiment, the triglyceride is a fatty triglyceride.

In one embodiment, the reaction mixture is substantially solvent free, where "substantially solvent free" means that the reaction mixture contains solvent(s) in an amount of 25% by weight or less; 20% by weight or less; 15% by weight or less; 10% by weight or less; 5% by weight or less; or 1% by weight or less. In another embodiment, the reaction mixture does not contain any solvent. In other embodiments, the reaction mixture can optionally contain one or more enzymes.

The product resulting from the transesterification process of the invention is primarily a mixture of polyol monoesters and polyol diesters. In one embodiment, the polyol monoester is a polyol fatty acid monoester. In another embodiment, the polyol diester is a polyol fatty acid diester. The product contains polyol fatty acid monoesters and polyol fatty acid diesters when the reaction mixture contains a fatty triglyceride. Other components of the transesterification reaction product can include glycerol, triglycerides, and the like.

The term "triglycerides" is intended to include any glyceryl triester or mixture of glyceryl triesters with the structure

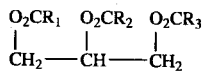

wherein $R_1$, $R_2$, and $R_3$ may be the same or different. Triglycerides may be derived from natural or synthetic sources, preferably from agricultural sources, more preferably from a vegetable oil and/or an animal fat. Triglycerides may be a mixture of compounds or a pure compound. A mixture of triglycerides may contain lesser amounts of diglycerides, monoglycerides, glycerol and/or partially hydrolyzed glycerides. Preferably, triglyceryl triesters will comprise more than about 95% of a mixture containing triglycerides.

The $R_1$, $R_2$, and $R_3$ groups of the major triglyceride components of a mixture should contain at least one carbon atom, the majority of those $R_1$, $R_2$, and $R_3$ groups may preferably contain about 1 to about 40 carbon atoms, preferably about 4 to about 30 carbon atoms, more preferably about 12 to about 24 carbon atoms. The $R_1$, $R_2$, and $R_3$ groups may contain any organic functional group, preferably saturated alkyl, unsaturated or polyunsaturated groups, more preferably any functional group found naturally in any vegetable oil.

A fatty triglyceride is one in which at least one of $R_1$, $R_2$, and $R_3$ contain 8–40 carbon atoms; 12–30 carbon atoms; or 12–24 carbon atoms. In another embodiment, a fatty triglyceride is one in which at least two of $R_1$, $R_2$, and $R_3$ contain 8–40 carbon atoms; 12–30 carbon atoms; or 12–24 carbon atoms. In still another embodiment, a fatty triglyceride is one in which each of $R_1$, $R_2$, and $R_3$ contain 8–40 carbon atoms; 12–30 carbon atoms; or 12–24 carbon atoms.

The term "polyol" is intended to include any aliphatic or aromatic compound containing at least two free hydroxyl groups. For example, suitable polyols may be selected from the following classes: saturated and unsaturated, straight and branched chain, linear aliphatics; saturated and unsaturated, cyclic aliphatics including heterocyclic aliphatics; or mononuclear and polynuclear aromatics, including heterocyclic aromatics. Preferred polyols for use in the reaction mixture and process described herein are aliphatic or aromatic compounds containing about 2 to about 12 free hydroxyl groups, more preferably about 2 or about 3 free hydroxyl groups. Preferred polyols include, for example, glycerol, propylene glycol, ethylene glycol, and mixtures of two or more thereof.

A base initiator, also known as a basic catalyst, is generally used to increase the rate of reaction for the transesterification of a triglyceride with a polyol to form polyol esters. Base initiators may include, for example, any base or mixture of bases suitable to perform the transesterification of a triglyceride with a polyol, including inorganic and organic bases, such as metal carbonates, hydroxides, oxides, or alkoxides, preferably alkali or alkaline earth hydroxides, carbonates, oxides or methoxides, more preferably hydroxide, oxide or carbonate salts of sodium, potassium, barium, calcium or magnesium, and most preferably carbonate or hydroxide salts of sodium, potassium or calcium. In one embodiment, the base initiator is $M^+B^-$ wherein M is sodium, potassium, calcium, barium, or magnesium and B is hydroxide, carbonate, oxide or methoxide.

The physical form of the base initiator may be any form suitable to perform the transesterification of a triglyceride with a polyol, including solid powder, solid granules, solid beads, or in solution. The preferred form is solid powder or beads.

The term "phase-transfer catalyst" is intended to include those chemical species referred to as phase-transfer catalysts in the authoritative reference "Phase-Transfer Catalysis: Fundamentals, Applications and Industrial Perspectives" by Starks, Liotta and Halpern (Chapman and Hall, 1994), the contents of which are incorporated herein by reference. Phase-transfer catalysts include quaternary ammonium salts, quaternary phosphonium salts, polyethylene glycols, polyethylene glycol ethers, polyethylene glycol esters, crown ethers, hexaalkyl guanidinium salts, complexants such as TDA-1, lariat ethers, tertiary amines, any of the above compounds bound to polymers and mixtures of two or more thereof. Preferred phase-transfer catalysts include quaternary ammonium and phosphonium salts, polyethylene glycols and derivatives of polyethylene glycols. Quaternary ammonium or phosphonium salts used may be symmetrical or nonsymmetrical and may contain functional groups other than straight chain alkyls, such as hydroxyalkyl groups and pendant esters. Quaternary ammonium or phosphonium compounds preferably contain about 8 to about 72 carbon atoms, more preferably about 16 to about 72 carbon atoms, most preferably about 24 to about 72 carbon atoms. Quaternary ammonium or phosphonium compounds preferably contain at least three alkyl chains containing about 4 carbon atoms or more each, more preferably contain at least three alkyl chains containing about 8 to about 18 carbon atoms each. Quaternary ammonium or phosphonium compounds containing at least three alkyl chains containing about 4 carbon atoms or more, preferably about 8 carbon atoms or more each, minimize the formation of undesirable stable emulsions at the end of the transesterification reaction. The anion of the quaternary onium salt may be any anion, preferably an inorganic anion, more preferably chloride, bromide, iodide, hydrogen sulfate, sulfate, methylsulfate, hydroxide and carbonate.

Polyethylene glycol and derivatives are of the form R—O—[(CHY)—$CH_2$O], R', wherein R is a hydrogen atom or an alkyl containing about 1 to about 24 carbons or ester containing about 1 to about 24 carbon atoms, R' is a hydrogen atom or an alkyl containing about 1 to about 24 carbon atoms or an ester containing about 1 to about 24 carbons, Y is a hydrogen atom or methyl. Preferably Y is a hydrogen atom. In the above formula, n is about 2 to about 150, preferably about 4 to about 35. R and R' may or may not be the same. Polyethylene glycol and derivatives preferably do not form stable emulsions at the end of the transesterification reaction.

In another embodiment, the phase transfer catalyst is a compound of the formula $RAR'_3{}^+X^-$; a compound of the formula R"—$(OCH_2CH_2)_n$ OR'"; or a mixture thereof; wherein A is nitrogen or phosphorous, R is a straight chain $C_1$–$C_{18}$ hydrocarbon, each R' is individually a straight chain $C_1$–$C_{18}$ hydrocarbon, X is chloride, bromide, iodide, hydrogen sulfate, methyl sulfate or sulfate, R" and R'" individually are hydrogen, an alkyl group of from about 1 to about 24 carbon atoms, or an esterified carboxylic acid, and n is from about 2 to about 150.

In other embodiments, the phase transfer catalyst is a salt of methyl tricaprylylammonium or methyl tridodecyl ammonium. In still other embodiments, the phase transfer catalyst is a polyethylene glycol of the formula R"—$(OCH_2CH_2)$n OR'" wherein R" and R'" individually are hydrogen, an alkyl group of from about 1 to about 8 carbon atoms, and n is from about 4 to about 50.

The transesterification reaction may be performed at any temperature suitable to obtain substantial reactivity. Transesterification of lower alkyl triglyceride esters (e.g., such as triacetin or tributyrin) may be performed with little or moderate heating, e.g., from about room temperature (21° C.) to about 100° C., more preferably from about room temperature (21° C.) to about 60° C. Transesterification of fatty triglycerides (e.g., such as canola oil) may be performed at higher temperatures, preferably from about room temperature to about 260° C.; room temperature to less than 200° C.; room temperature to about 180° C.; or about 60° C.

to about 250° C.; or about 100° C. to about 200° C. Transesterification should be performed with sufficient agitation to obtain substantial reactivity. The transesterification may be performed under any atmosphere, but is preferably performed under an inert atmosphere. The transesterification reaction can proceed from about 1 minute to about 10 hours or more at temperatures up to about 200° C. The transesterification reaction can proceed from about 1 minute to about 1 hour (e.g., about 1 minute to about 4 minutes; or about 1 minute to about 3 minutes) at temperatures greater than about 200° C.

The transesterification may be performed using a ratio of polyol to triglyceride which is suitable to obtain the desired product and will depend on the identities of the polyol and the triglyceride. Such ratios are routinely determined by one of ordinary skill in the art. The molar ratio of polyol to triglyceride may be about 0.25 to about 20. To produce a mixture which is predominantly monoglyceride by reacting glycerol and triglyceride, a suitable molar ratio of glycerol to triglyceride is about 2 to about 10, preferably about 3 to about 6. To produce a mixture which is predominantly diglyceride by reacting glycerol and triglyceride, a suitable molar ratio of glycerol to triglyceride is about 0.25 to about 1. To produce a mixture which is predominantly monoglyceride by reacting triglyceride and a diol, such as propylene glycol, a suitable molar ratio of diol to triglyceride is about 2 to about 6.

The transesterification may be performed in the presence of any quantity of phase-transfer catalyst suitable to obtain substantial reactivity. The quantity of phase transfer catalyst relative to triglyceride may be in the range of about 0.001 mole % to about 5 mole %, preferably about 0.01 mole % to about 2 mole %.

The transesterification may be performed in the presence of any quantity of base initiator suitable to obtain substantial reactivity. The quantity of base initiator relative to triglyceride may be in the range of about 0.0001 mole % to about 5 mole %, preferably about 0.01 mole % to about 1 mole %.

EXAMPLES

The invention is further illustrated by the following non-limiting examples.

Example 1

A reaction mixture of about 18.15 grams of tributyrin (98% glyceryl tributyrate), about 11.08 grams glycerol, about 0.12 grams sodium hydroxide in the form of 20–40 mesh beads, and about 0.26 grams ALIQUAT® 336 (methyl tricaprylyl ammonium chloride; available from Cognis Corporation, Tucson, Ariz., U.S.A.) is prepared and added to a 50 mL glass graduated cylinder which serves as a reaction vessel. The volume of the lower phase is observed to be about 9.5 mL. The volume of the upper phase is observed to be about 20.2 mL. The reaction vessel is equipped with a heating bath, a thermocouple, a temperature controller, and an agitator. The diameter of the reaction vessel/graduated cylinder is about 23 mm and the agitator blade is rectangular with dimensions of about 15 mm×15 mm. The agitator blade is adjusted so that it is located at the liquid-liquid interface at the outset of the reaction. The reaction mixture is heated to about 62° C. The reaction mixture is agitated. After 10 about minutes, the reaction mixture is observed to be one phase. Samples are taken from the reaction vessel from time to time and analyzed for composition by gas chromatography. The approximate sample composition is shown below.

| Time Minutes | Glycerol GC Area % | Glyceryl Monobutyrate GC Area % | Glyceryl Dibutyrate GC Area % | Glyceryl Tributyrate GC Area % |
|---|---|---|---|---|
| 10 | 70% | 16% | 12% | 4% |
| 22 | 16% | 48% | 31% | 4% |
| 130 | 16% | 48% | 31% | 4% |

Comparative Example A

A reaction similar to the reaction described in Example 1 is conducted in the absence of ALIQUAT® 336. Two phases are observed throughout the reaction and samples of each phase are taken from time to time and analyzed for composition by gas chromatography. The approximate sample composition is shown below.

Lower Phase

| Time Minutes | Volume mL | Glycerol GC Area % | Glyceryl Monobutyrate GC Area % | Glyceryl Dibutyrate GC Area % | Glyceryl Tributyrate GC Area % |
|---|---|---|---|---|---|
| 10 | 9.5 | 88% | 5% | 2% | 6% |
| 120 | 9.9 | 71% | 13% | 2% | 14% |
| 420 | 9.9 | 67% | 12% | 2% | 18% |

Upper Phase

| Time Minutes | Volume mL | Glycerol GC Area % | Glyceryl Monobutyrate GC Area % | Glyceryl Dibutyrate GC Area % | Glyceryl Tributyrate GC Area % |
|---|---|---|---|---|---|
| 10 | 20.3 | 0% | 0% | 0% | 100% |
| 120 | 19.9 | 1% | 6% | 7% | 86% |
| 420 | 19.9 | 3% | 7% | 8% | 82% |

Hence, a conventional transesterification reaction between tributyrin and glycerol in the absence of a phase-transfer catalyst reacts very sluggishly at about 62° C.

Example 2

A reaction mixture of about 7.57 grams of tributyrin (98% glyceryl tributyrate), about 4.61 grams glycerol, about 0.17 grams granular potassium carbonate and about 0.12 grams PEG-400 (polyethylene glycol with molecular weight ~400) is prepared and added to a 30 mL vial which serves as a reaction vessel. The reaction vessel is placed in a heating bath on a magnetic stirrer-hot plate and is agitated by a magnet 13 mm×10 mm. The diameter of the reaction vessel/vial is about 21 mm. The reaction mixture is heated to about 56–66° C. for about 240 minutes. A sample is taken from the upper phase and is analyzed by gas chromatography. The approximate sample composition of the glyceride esters (not including glycerol) is shown below.

| Upper Phase | | |
|---|---|---|
| Glyceryl Monobutyrate | Glyceryl Dibutyrate | Glyceryl Tributyrate |
| 14% | 19% | 68% |

Comparative Example B

A reaction similar to the reaction described in Example 2 is conducted in the absence of PEG-400 and in the temperature range of 60–85° C. for about 210 minutes. A sample is taken from the upper phase and is analyzed by gas chromatography. The approximate sample composition of the glyceride esters (not including glycerol) is shown below.

| Upper Phase | | |
|---|---|---|
| Glyceryl Monobutyrate | Glyceryl Dibutyrate | Glyceryl Tributyrate |
| 1% | 2% | 97% |

Hence, a transesterification reaction between tributyrin and glycerol in the presence of granular potassium carbonate and in the absence of a phase-transfer catalyst does not react substantially at about 60–85° C.

Example 3

A reaction mixture of about 30.9 grams of canola oil (CRISCO®, available from Proctor & Gamble Corporation, Cincinnati, Ohio, U.S.A.), about 5.53 grams glycerol, about 0.21 grams potassium carbonate (98%) in the form of 325 mesh beads, and about 0.19 grams methyl trilauryl ammonium methylsulfate is prepared and added to a 50 mL glass graduated cylinder which serves as a reaction vessel. The volume of the lower phase is observed to be about 4.9 mL. The volume of the upper phase is observed to be about 34.0 mL. The reaction vessel is equipped with a heating bath, a thermocouple, a temperature controller, and an agitator. The diameter of the reaction vessel/graduated cylinder is about 23 mm and the agitator blade is rectangular with dimensions of about 15 mm×15 mm. The agitator blade is adjusted so that it is located at the liquid-liquid interface at the outset of the reaction. The reaction mixture is heated to about 100° C. The reaction mixture is agitated at about 650 rpm for about 380 minutes. The reaction mixture is allowed to settle and cool. At completion of the reaction, the volume of the lower phase is observed to be about 0.3 mL, which represents a reduction in volume of the lower phase of 4.6 mL.

Comparative Example C

A reaction similar to the reaction described in Example 3 is conducted in the absence of methyl trilauryl ammonium methylsulfate. The reaction mixture is agitated at about 650 rpm for about 420 minutes. The reaction mixture is allowed to settle and cool. At completion of the reaction, the volume of the lower phase is observed to be about 4.9 mL, which indicates that the lower phase was not detectably reduced in volume. Hence, a conventional transesterification reaction between canola oil triglyceride and glycerol in the absence of a phase-transfer catalyst does not react substantially at about 100° C.

Example 4

A reaction similar to the reaction described in Example 3 is conducted and the upper phase analyzed. The approximate sample composition is shown below.

| Upper Phase | | | |
|---|---|---|---|
| Glycerol | Monoglyceride GC Area % | Diglyceride GC Area % | Triglyceride GC Area % |
| 4% | 40% | 42% | 14% |

Example 5

A reaction similar to the reaction described in Example 3 is conducted at about 60° C. At the outset of the reaction, the volume of the lower phase is observed to be about 4.9 mL and the volume of the upper phase is observed to be about 34.0 mL. The reaction mixture is agitated at about 650 rpm at about 60° C. for about 430 minutes. At completion of the reaction, the volume of the lower phase is observed to be about 3.1 mL, which represents a reduction in volume of the lower phase of 1.8 mL.

Example 6

A reaction similar to the reaction described in Example 5 is conducted, except the reaction temperature is about 65° C. and the potassium carbonate is in the form of granules of about 1 mm in diameter. At the outset of the reaction, the volume of the lower phase is observed to be about 4.8 mL and the volume of the upper phase is observed to be about 34.0 mL. The reaction mixture is agitated at about 650 rpm at about 65° C. for about 110 minutes. At completion of the reaction, the volume of the lower phase is observed to be about 4.1 mL, which represents a reduction in volume of the lower phase of 0.7 mL.

Example 7

A reaction similar to the reaction described in Example 5 is conducted and the upper phase analyzed. The approximate sample composition is shown below.

| Upper Phase | | | |
|---|---|---|---|
| Glycerol | Monoglyceride GC Area % | Diglyceride GC Area % | Triglyceride GC Area % |
| 0.3% | 11% | 33% | 55% |

Example 8

A reaction mixture of about 30.9 grams of canola oil (CRISCO®), about 5.57 grams glycerol, about 0.06 grams of sodium hydroxide in the form of 20–40 mesh beads and about 0.14 grams ALIQUAT® 336 is prepared and added to a 50 mL glass graduated cylinder which serves as a reaction vessel. The volume of the lower phase is observed to be about 4.9 mL. The volume of the upper phase is observed to be about 34.0 mL. The reaction vessel is equipped with a heating bath, a thermocouple, a temperature controller, and an agitator. The diameter of the reaction vessel/graduated cylinder is about 23 mm and the agitator blade is rectangular with dimensions of about 15 mm×15 mm. The agitator blade is adjusted so that it is located at the liquid-liquid interface at the outset of the reaction. The reaction mixture is heated to about 63° C. The reaction mixture is agitated at about 650 rpm for about 430 minutes. The reaction mixture is allowed to settle and cool. At completion of the reaction, the volume of the lower phase is observed to be about 3.8 mL, which represents a reduction in volume of the lower phase of 1.1 mL.

Comparative Example D

A reaction similar to the reaction described in Example 8 is conducted in the absence of ALIQUAT® 336. The reaction mixture is agitated at about 650 rpm for about 488 minutes. The reaction mixture is allowed to settle and cool. At completion of the reaction, the volume of the lower phase is observed to be about 4.9 mL, which indicates that the lower phase was not detectably reduced in volume. Hence, a conventional transesterification reaction between canola oil triglyceride and glycerol in the absence of a phase-transfer catalyst does not react substantially at about 63° C.

Example 9

A reaction similar to the reaction described in Example 8 is conducted at a temperature of about 99° C. The reaction mixture is agitated at about 650 rpm for about 420 minutes. The reaction mixture is allowed to settle and cool. At completion of the reaction, the volume of the lower phase is observed to be about 1.5 mL, which represents a reduction in volume of the lower phase of 3.4 mL.

Comparative Example E

A reaction similar to the reaction described in Example 8 is conducted in the absence of ALIQUAT® 336 and at a temperature of about 100° C. The reaction mixture is agitated at about 650 rpm for about 420 minutes. The reaction mixture is allowed to settle and cool. At completion of the reaction, the volume of the lower phase is observed to be about 4.9 mL, which indicates that the lower phase was not detectably reduced in volume. Hence, a conventional transesterification reaction between canola oil triglyceride and glycerol in the absence of a phase-transfer catalyst does not react substantially at about 100° C.

Example 10

A reaction mixture of about 17.71 grams of canola oil (CRISCO®), about 3.72 grams ethylene glycol, about 0.040 grams of sodium hydroxide in the form of 20–40 mesh beads and about 0.086 grams ALIQUAT® 336 is prepared and added to a 30 mL vial with a diameter of 21 mm which serves as a reaction vessel. The height of the lower ethylene glycol phase is observed to be about 10 mm. The mixture is agitated by a magnet 13 mm×10 mm at room temperature for about 17 hours. At completion of the reaction, the height of the lower phase is observed to be about 5 mm, which represents about a 50% reduction in volume of the lower phase. When the same procedure is performed in the absence of Aliquat® 336, a reduction in height of the lower phase is observed to be less than 1 mm.

Example 11

A reaction mixture of about 17.71 grams of canola oil (CRISCO®), about 3.72 grams ethylene glycol, about 0.138 grams of potassium carbonate and about 0.086 grams ALIQUAT® 336 is prepared and added to a 30 mL vial with a diameter of 21 mm which serves as a reaction vessel. The height of the lower ethylene glycol phase is observed to be about 10 mm. The mixture is agitated by a magnet 13 mm×10 mm at room temperature for about 17 hours. At completion of the reaction, the height of the lower phase is observed to be about 5 mm, which represents about a 50% reduction in volume of the lower phase. When the same procedure is performed in the absence of Aliquat® 336, a reduction in height of the lower phase is observed to be less than 1 mm.

Example 12

A reaction mixture of about 8.85 grams of canola oil (CRISCO®), about 2.28 grams propylene glycol, about 0.020 grams of sodium hydroxide in the form of 20–40 mesh beads and about 0.065 grams methyl trilauryl ammonium methylsulfate is prepared and added to a 30 mL vial with a diameter of 21 mm which serves as a reaction vessel. The height of the lower propylene glycol phase is observed to be about 7 mm. The mixture is agitated by a magnet 13 mm×10 mm at room temperature for about 15 hours. At completion of the reaction, the height of the lower phase is observed to be less than 1 mm, which represents a significant reduction in volume of the lower phase. When the sodium hydroxide is replaced by 0.069 grams potassium carbonate, essentially identical results are observed.

Example 13

A reaction mixture of about 8.85 grams of canola oil (CRISCO®), about 2.28 grams propylene glycol, about 0.069 grams of potassium carbonate in the form of a 325 mesh powder and about 0.075 grams trioctyl octadecyl phosphonium iodide (obtained from Cytec) is prepared and added to a 30 mL vial with a diameter of 21 mm which serves as a reaction vessel. The height of the lower propylene glycol phase is observed to be about 7 mm. The mixture is agitated by a magnet 13 mm×10 mm, at room temperature for about 15 hours. At completion of the reaction, the height of the lower phase is observed to be about 1.5 mm, which represents a significant reduction in volume of the lower phase.

Example 14

A reaction mixture of about 268.67 grams of canola oil (CRISCO®), about 130.8 grams glycerol, about 0.30 grams of powdered sodium hydroxide and about 6.04 grams of PEG-400 (polyethylene glycol with molecular weight ~400) is prepared and added to a mantle-heated 1-Liter 4-necked flask, fitted with a glass stirring shaft having a teflon D-shaped 75-mm stir blade, a Type J thermocouple, a nitrogen subsurface sparge line, and a distillation apparatus consisting of a goose-neck tube attached to a condenser, a vacuum pump and a 100 mL receiving flask. The mixture is agitated at about 600 rpm, sparged with nitrogen and heated at about 200° C. for about 60 minutes. The reaction is stopped by neutralizing the base with acid. Glycerol is stripped from the mixture under reduced pressure. Analysis of the product by a standard periodic acid titration method shows that the product contains 21% α-monoglyceride.

Comparative Example F

A reaction similar to the reaction described in Example 14 is conducted in the absence of polyethylene glycol. Analysis of the product by a standard periodic acid titration method shows that the product contains 4% α-monoglyceride. Hence, a conventional transesterification reaction between canola oil triglyceride and glycerol in the absence of a phase-transfer catalyst reacts sluggishly at about 200° C.

Example 15

A reaction mixture of about 120.0 grams of canola oil (CRISCO®), about 30.0 grams glycerol, about 0.83 grams of potassium carbonate in the form of 325 mesh powder and about 2.71 grams of PEG-400 (polyethylene glycol with molecular weight ~400) is prepared and added to a mantle-heated 500 mL 4-necked flask, fitted with a glass stirring shaft having a teflon D-shaped stir blade, a Type J thermocouple and an above-surface nitrogen sweep line. The mixture is agitated at about 500 rpm under nitrogen sweep and heated at about 200° C. for about 60 minutes. Agitation is stopped and the mixture is allowed to cool to room temperature. Analysis of the product after glycerol removal by extraction, using a standard periodic acid titration method shows that the product contains 27% α-monoglyceride.

Example 16

A reaction similar to the reaction described in Example 15 is conducted, wherein the PEG-400 is replaced by about 4.07 grams of the dicetyl ether of PEG-600 (each terminal hydroxyl group of polyethylene glycol with molecular weight ~600 is etherified with a hexadecyl group; obtained from Clariant). Analysis of the product after glycerol removal by extraction, using a standard periodic acid titration method shows that the product contains 25% α-monoglyceride.

It will be appreciated by one of ordinary skill in the art that changes could be made to the embodiments described above without departing from the broad inventive concept thereof. It is understood, therefore, that this invention is not limited to the particular embodiments disclosed, but is intended to cover modifications within the spirit and scope of the present invention as defined by the appended claims.

What is claimed is:

1. A reaction mixture for synthesizing polyol monoesters and polyol diesters comprising at least one phase transfer catalyst, at least one triglyceride, at least one base initiator, and at least one polyol.

2. The reaction mixture of claim 1, wherein the phase transfer catalyst is a quaternary ammonium salt, a quaternary phosphonium salt, a polyethylene glycol, a polyethylene glycol ether, a polyethylene glycol ester, a crown ether, a hexaalkyl guanidinium salt, TDA-1, a lariat ether, a tertiary amine, any of the above compounds bound to a polymer, a derivative thereof or a mixture of two or more thereof.

3. The reaction mixture of claim 1, wherein the phase transfer catalyst is a compound of the formula $RAR'_3{}^+X^-$; a compound of the formula $R''—(OCH_2CH_2)_n\ OR'''$; or a mixture thereof; wherein A is nitrogen or phosphorous, R is a straight chain $C_1$–$C_{18}$ hydrocarbon, each R' is individually a straight chain $C_1$–$C_{18}$ hydrocarbon, X is chloride, bromide, iodide, hydrogen sulfate, methyl sulfate or sulfate, R" and R'"individually are hydrogen, an alkyl group of from about 1 to about 24 carbon atoms, or an esterified carboxylic acid, and n is from about 2 to about 150.

4. The reaction mixture of claim 1, wherein the phase transfer catalyst is a salt of methyl tricaprylylammonium or methyl tridodecyl ammonium.

5. The reaction mixture of claim 1, wherein the phase transfer catalyst is a polyethylene glycol of the formula $R''—(OCH_2CH_2)_n\ OR'''$ wherein R" and R'" individually are hydrogen, an alkyl group of from about 1 to about 18 carbon atoms, and n is from about 4 to about 50.

6. The reaction mixture of claim 1, wherein the triglyceride is derived from vegetable oil or animal fat.

7. The reaction mixture of claim 1, wherein the base initiator is a metal carbonate, a hydroxide, an oxide, an alkoxide, or a mixture of two or more thereof.

8. The reaction mixture of claim 1, wherein the base initiator is $M^+B^-$ wherein M is sodium, potassium, calcium or magnesium and B is hydroxide, carbonate, oxide or methoxide.

9. The reaction mixture of claim 1, wherein the polyol is an aliphatic compound having 2 to 12 free hydroxyl groups, an aromatic compound having 2 to 12 free hydroxyl groups, or a mixture thereof.

10. The reaction mixture of claim 1, wherein the polyol is glycerol, propylene glycol, ethylene glycol, or a mixture of two or more thereof.

11. The reaction mixture of claim 1, wherein the molar ratio of the polyol to the triglyceride is in the range of about 2:1 to about 10:1.

12. A method for synthesizing polyol monoesters and polyol diesters comprising mixing at least one phase transfer catalyst, at least one triglyceride, at least one base initiator, and at least one polyol to produce the polyol monoesters and polyol diesters.

13. The method of claim 12, comprising mixing at least one phase transfer catalyst, at least one triglyceride, at least one base initiator, and at least one polyol; and heating the resulting mixture to produce the polyol monoesters and polyol diesters.

14. The method of claim 12, comprising mixing at least one phase transfer catalyst, at least one triglyceride, at least one base initiator, and at least one polyol; and heating and stirring the resulting mixture to produce the polyol monoesters and polyol diesters.

15. The method of claim 12, wherein the phase transfer catalyst is a quaternary ammonium salt, a quaternary phosphonium salt, a polyethylene glycol, a polyethylene glycol ether, a polyethylene glycol ester, a crown ether, a hexaalkyl guiandinium salt, TDA-1, a lariat ether, a tertiary amine, any of the above compounds bound to a polymer, a derivative thereof or a mixture of two or more thereof.

16. The method of claim 12, wherein the phase transfer catalyst is a compound of the formula $RAR'_3{}^+X^-$; a compound of the formula $R''—(OCH_2CH_2)_n\ OR'''$; or a mixture thereof; wherein A is nitrogen or phosphorous, R is a straight chain $C_1$–$C_{18}$ hydrocarbon, each R' is individually a straight chain $C_1$–$C_{18}$ hydrocarbon, X is chloride, bromide, iodide, hydrogen sulfate, methyl sulfate or sulfate, R" and R'" individually are hydrogen, an alkyl group of from about 1 to about 24 carbon atoms, or an esterified carboxylic acid, and n is from about 2 to about 150.

17. The method of claim 12, wherein the phase transfer catalyst is a salt of methyl tricaprylylammonium or methyl tridodecyl ammonium.

18. The method of claim 12, wherein the phase transfer catalyst is a polyethylene glycol of the formula R"—$(OCH_2CH_2)_n$ OR'" wherein R" and R'" individually are hydrogen, an alkyl group of from about 1 to about 18 carbon atoms, and n is from about 4 to about 50.

19. The method of claim 12, wherein the triglyceride is derived from vegetable oil or animal fat.

20. The method of claim 12, wherein the base initiator is a metal carbonate, a hydroxide, an oxide, an alkoxide, or a mixture of two or more thereof.

21. The method of claim 12, wherein the base initiator is $M^+B^-$ wherein M is sodium, potassium, calcium or magnesium and B is hydroxide, carbonate, oxide or methoxide.

22. The method of claim 12, wherein the polyol is an aliphatic compound having 2 to 12 free hydroxyl groups, an aromatic compound having 2 to 12 free hydroxyl groups, or a mixture thereof.

23. The method of claim 12, wherein the polyol is glycerol, propylene glycol, ethylene glycol, or a mixture of two or more thereof.

24. The method of claim 13, comprising heating the mixture at a temperature less than or equal to about 260° C. to produce the polyol monoesters and polyol diesters.

25. The method of claim 24, comprising heating the mixture at a temperature less than or equal to about 200° C. to produce the polyol monoesters and polyol diesters.

26. The method of claim 14, wherein the molar ratio of the polyol to the triglyceride is in the range of about 2:1 to about 10:1.

27. The method of claim 14, wherein the polyol monoester is a polyol fatty acid monoester and the polyol diester is a polyol fatty acid diester.

* * * * *